US009520261B2

(12) United States Patent
Kaika et al.

(10) Patent No.: US 9,520,261 B2
(45) Date of Patent: Dec. 13, 2016

(54) BEARING UNIT FOR ROTARY ANODES OF X-RAY TUBES

(71) Applicant: Paul Mueller GmbH & Co. KG Unternehmensbeteiligungen, Nuremberg (DE)

(72) Inventors: Wolfgang Kaika, Neunkirchen a.S. (DE); Stefan Tritthart, Nuremberg (DE); Thomas Maussner, Heroldsberg (DE)

(73) Assignee: Paul Mueller GmbH & Co. KG Unternehmensbeteiligungen, Nuremberg (DE)

( * ) Notice: Subject to any disclaimer, the term of this patent is extended or adjusted under 35 U.S.C. 154(b) by 6 days.

(21) Appl. No.: 14/442,444

(22) PCT Filed: Nov. 19, 2013

(86) PCT No.: PCT/DE2013/100390

§ 371 (c)(1),
(2) Date: May 13, 2015

(87) PCT Pub. No.: WO2014/075664

PCT Pub. Date: May 22, 2014

(65) Prior Publication Data

US 2016/0155599 A1 Jun. 2, 2016

(30) Foreign Application Priority Data

Nov. 19, 2012 (DE) ..... 20 2012 104 447 U

(51) Int. Cl.
*H01J 35/10* (2006.01)

(52) U.S. Cl.
CPC ..... *H01J 35/101* (2013.01); *H01J 2235/102* (2013.01); *H01J 2235/1046* (2013.01); *H01J 2235/1053* (2013.01)

(58) Field of Classification Search
CPC ..... H01J 35/101; H01J 2235/102; H01J 2235/1046; H01J 2235/1053
See application file for complete search history.

(56) References Cited

U.S. PATENT DOCUMENTS 3,694,685 A * 9/1972 Houston ..... H01J 35/106 313/11
4,949,368 A * 8/1990 Kubo ..... H01J 35/101 378/132

(Continued)

FOREIGN PATENT DOCUMENTS

DE 30 41 558 A1 6/1982
EP 0 351 225 A2 1/1990

(Continued)

OTHER PUBLICATIONS

International Search Report of PCT/DE2013/100390, mailed Apr. 8, 2014.

*Primary Examiner* — Wyatt Stoffa
(74) *Attorney, Agent, or Firm* — Collard & Roe, P.C.

(57) ABSTRACT

A bearing unit for rotary anodes of x-ray tubes includes a shaft and a flange element to which a rotary anode can be attached, wherein: the bearing unit can be inserted into a cutout within the x-ray tube and locked in place; the shaft is mounted via a first bearing element and a further bearing element; the first bearing element and the further bearing element each consists of an angular ball bearing mounted on the shaft and having an inner ring and an outer ring; and at least one spacer element is mounted between the inner rings and/or the outer rings of the first and the second bearing element.

8 Claims, 2 Drawing Sheets

(56) References Cited

U.S. PATENT DOCUMENTS

| | | | | |
|---|---|---|---|---|
| 5,527,401 | A * | 6/1996 | Kim | C22C 38/14 148/648 |
| 6,693,990 | B1 * | 2/2004 | Andrews | H01J 35/101 378/119 |
| 2004/0086081 | A1 * | 5/2004 | Dahan | F16C 27/04 378/144 |
| 2008/0118030 | A1 * | 5/2008 | Lee | F16C 33/66 378/132 |
| 2008/0240359 | A1 * | 10/2008 | Otsuka | F16C 19/20 378/121 |
| 2009/0129548 | A1 * | 5/2009 | Kaika | H01J 35/101 378/132 |
| 2010/0128848 | A1 * | 5/2010 | Qiu | H01J 35/101 378/133 |
| 2010/0246774 | A1 * | 9/2010 | Lathrop | H01J 35/101 378/133 |
| 2012/0144939 | A1 * | 6/2012 | Kullin | H01J 35/101 74/25 |

FOREIGN PATENT DOCUMENTS

| | | |
|---|---|---|
| EP | 1 843 381 A1 | 10/2007 |
| EP | 1 975 428 A1 | 10/2008 |

* cited by examiner

BEARING UNIT FOR ROTARY ANODES OF X-RAY TUBES

CROSS REFERENCE TO RELATED APPLICATIONS

This application is the National Stage of PCT/DE2013/100390 filed on Nov. 19, 2013, which claims priority under 35 U.S.C. §119 of German Application No. 20 2012 104 447.1 filed on Nov. 19, 2012, the disclosure of which is incorporated by reference. The international application under PCT article 21(2) was not published in English.

The invention relates to a bearing unit for rotary anodes of X-ray tubes.

DE 30 41 558 A1, for example by way of FIG. 1 in the drawings, discloses a bearing unit for rotary anodes of X-ray tubes, wherein the rotary anode is accommodated in an evacuated glass bulb which is partially reproduced.

The invention is based on the object of producing a bearing unit for rotary anodes of this type of X-ray tubes that is particularly easy to assemble.

This object is achieved by a bearing unit having the features of claim 1. Advantageous embodiments are described in the dependent claims.

The bearing unit according to the invention, having the features of patent claim 1, is configured in a compact manner and is composed of a modest number of parts which may be pre-assembled in order for the thus pre-assembled bearing unit to be able to be inserted in a manner which is easy to assemble into the corresponding receptacle in the X-ray tube.

On account of the implementation of the first bearing elements as angular ball bearings, it is made possible to a certain degree for the bearing unit to also absorb axial forces. Moreover, on account of the use of two angular ball bearings, complex shaft production is dispensed with. It is also possible for a comparatively cost-effective material (untempered steel, for example) to be used for the shaft.

The spacer elements make for a positionally secure location of the bearing elements on the shaft, wherein the inboard spacer element is in contact with the internal rings of the angular ball bearings and the outboard spacer element is in contact with the external rings of the angular ball bearing.

According to a further advantageous embodiment, one angular ball bearing or both angular ball bearings by way of the internal ring bear(s) on a step of the shaft and in the axial direction is/are thus fixed in a manner which is easy to assemble.

On account of the further bearing element being fastened by way of a tapered bracing element which, in particular, is form-fitting, or by way of a plastic deformation of the shaft, respectively, locking in place of the angular ball bearings and thus fixing of the entire bearing unit may take place in a manner which is easy to assemble, once the bearing elements have been attached to the shaft. These here are rapid and simple fixing possibilities which are more cost-effective than fixing solutions which are based on a screw-nut or similar.

In one advantageous embodiment the angular ball bearings are oriented so as to be mutually opposed, that is to say that the respective open sides of the angular ball bearings either face one another or face away from one another. In a particularly preferable way, the open shoulder of the angular ball bearing of the first bearing element is disposed in the direction of the flange-side end of the shaft and the open shoulder of the angular ball bearing of the further bearing element is disposed in the direction of that end of the shaft that is distant from the flange. On account thereof, a particularly advantageous bearing, in particular the absorption of axial forces from various axial directions, is enabled.

According to a further advantageous embodiment, the spacer element which is disposed between the external rings and/or the internal rings of the bearing elements may be configured as split spacer elements. A split spacer element here is to be understood to be a spacer element which is composed of a plurality of separate parts (for example, a plurality of ring segments). In this way, for example, a first (for example, comparatively large) ring segment produced to a standard size may be used, and furthermore one spacer element or a plurality of spacer elements produced to the exact dimension may be used for filling in the desired spacing between the external rings and/or internal rings of the bearing elements.

The invention is explained in more detail by means of exemplary embodiments in the figures of the drawing, in which.

Figure 1:
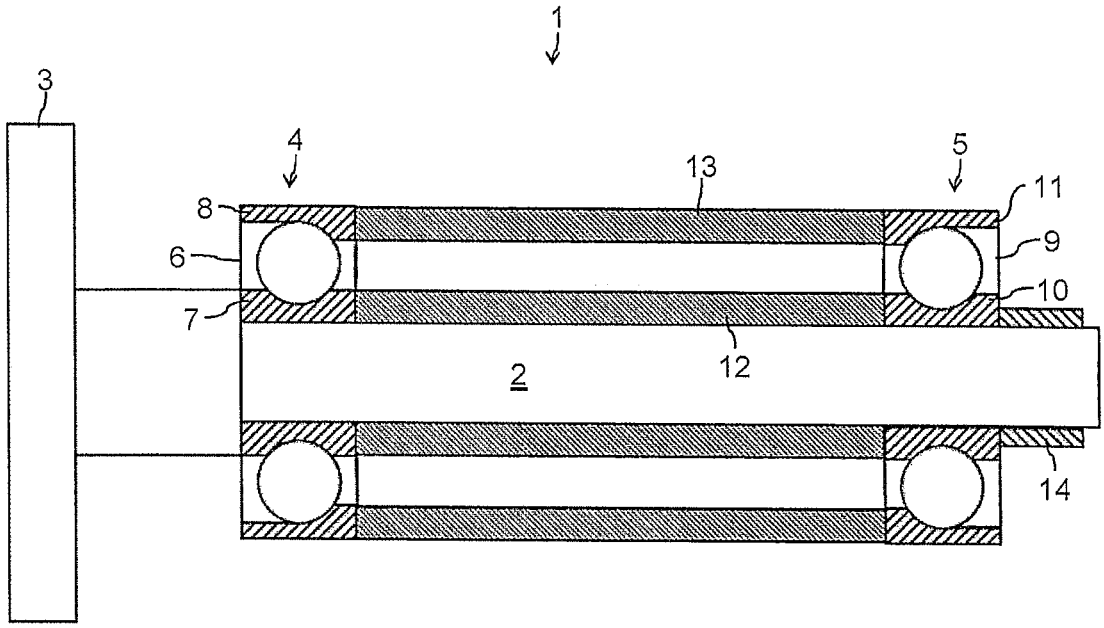
FIG. 1 shows a schematic partial view of a bearing unit.

The bearing unit 1 illustrated in FIG. 1 has a shaft 2 with a flange element 3 on which a rotary anode (for example, according to DE 30 41 558 A1) is attachable.

The entire bearing unit 1 here may be inserted into a receptacle (not illustrated) of the X-ray tube, which is provided therefor, and locked in place there in the usual way (for example, by a screw connection).

The bearing unit 1, for receiving the shaft 2, has a first bearing element 4 and a further bearing element 5. The first bearing element 4 is formed by an angular ball bearing 6 which is attached on the shaft 2 and which has an internal ring 7 and an external ring 8. The second bearing element 5 is formed by an angular ball bearing 9 which is attached on the shaft 2 and which has an internal ring 10 and an external ring 11.

The open side of the angular ball bearing 6 is configured on the external ring 8 and is disposed in the direction of the flange-side end of the shaft 2. Two shoulders are configured on the internal ring 7, and that side of the angular ball bearing 6 that faces away from the flange 3 is likewise configured as a shoulder.

The open side of the angular ball bearing 9 is configured on the external ring 11 and is disposed in the direction of that end of the shaft 2 that is opposite the flange 3. Two shoulders are configured on the internal ring 10, and that side of the angular ball bearing 9 that faces the flange 3 is likewise configured as a shoulder on the external ring 11.

The internal rings 7 and 10 are spaced apart in a dimensionally exact manner by way of a spacer element 12. In a similar way, a further spacer element 13 is disposed between the external rings 8 and 11.

The angular ball bearing 6 by way of its internal ring 7 bears on a step of the shaft 2.

By way of the bracing element 14 which is attached on that end of the shaft that is distant from the flange the assembled bearing unit 1 is locked in place. The bracing element 14 is configured in a sleeve-shaped manner. In more precise terms, the bracing element 14 has the shape of a ring or of a hollow cylinder, respectively.

Figure 2:
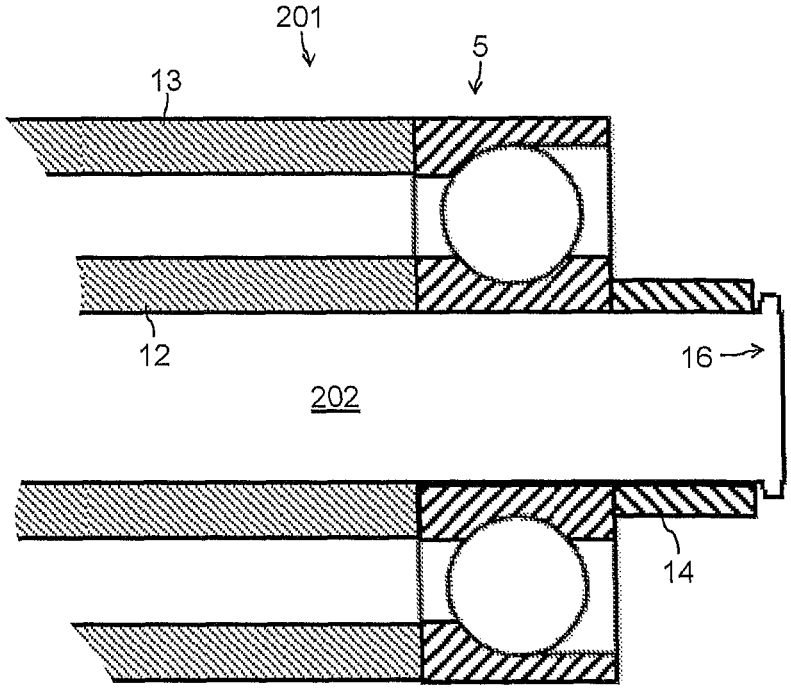
FIG. 2 shows an enlarged detail with a bearing unit, the bracing element of which is locked in place by plastic deformation of the shaft.

FIG. 2 shows an enlarged detail of a bearing unit 201. The bearing unit 201 differs from the bearing unit 1 only in that it has a shaft 202 which is configured in a different manner.

The further components remain unchanged, such that reference here may be made to the narrative pertaining to FIG. 1.

The bracing element 14 in the embodiment according to FIG. 2 is locked in place on the shaft 202 by way of a plastically deformed end region 16 of the shaft 202. Axial displacement of the bracing element 14 is no longer possible. The components of the bearing unit 201 are thus securely tensioned in relation to one another. The plastic deformation of the end region 16 of the shaft 202 may take place by applying a force which is directed in an axial direction of the shaft, for example. Except for the plastically deformed end region 16, the shaft 202 is identical to the shaft 2 of FIG. 1.

LIST OF REFERENCE SIGNS

1, 201 Bearing unit
2, 202 Shaft
3 Flange
4, 5 Bearing element
6 Angular ball bearing
7 Internal ring
8 External ring
9 Angular ball bearing
10 Internal ring
11 External ring
12, 13 Spacer element
14 Bracing element
16 Deformed end region

The invention claimed is:

1. A bearing unit for rotary anodes of X-ray tubes, having a shaft and a flange element on which a rotary anode is attachable, wherein the bearing unit is insertable into a receptacle within the X-ray tube and is lockable in place therein, the shaft is received by way of a first bearing element and a second bearing element, the first bearing element and the second bearing element are in each case composed of an angular ball bearing which is disposed on the shaft and has an internal ring and an external ring, at least one spacer element is attached between the internal rings of the first bearing element and of the second bearing element and/or between the external rings of the first bearing element and of the second bearing element, wherein the angular ball bearing of the second bearing element is fastened by way of a bracing element on the shaft, wherein the bracing element is configured as a tapered bracing element, and wherein the bracing element is fixed by way of a plastically deformed end region of the shaft.

2. The bearing unit as claimed in claim 1, wherein at least one spacer element is attached between the internal rings of the first bearing element and of the second bearing element and at least one spacer element is attached between the external rings of the first and of the second bearing element.

3. The bearing unit as claimed in claim 1, wherein the first bearing element and/or the second bearing element by way of their internal ring bear on a step of the shaft.

4. The bearing unit as claimed in claim 1, wherein the shaft is composed of a non-tempered steel material.

5. The bearing unit as claimed in claim 1, wherein the angular ball bearings are oriented so as to be mutually opposed.

6. The bearing unit as claimed in claim 1, wherein the angular ball bearing of the first bearing element has an open side disposed toward a flange-side first end of the shaft.

7. The bearing unit as claimed in claim 1, wherein the angular ball bearing of the second bearing element has an open side disposed toward a second end of the shaft that is opposite the flange element.

8. The bearing unit as claimed in claim 1, wherein each of the angular ball bearings has a respective open side configured on the respective external ring.

* * * * *